US005203838A

United States Patent [19]

Schneider

[11] Patent Number: 5,203,838

[45] Date of Patent: Apr. 20, 1993

[54] ASSEMBLY COMPRISING AN OPENING CAPSULE AND A RECEPTACLE WITH A TAMPERPROOF COVER

[75] Inventor: Bernard Schneider, Sainte Menehould, France

[73] Assignee: Cebal, Clichy, France

[21] Appl. No.: 745,235

[22] Filed: Aug. 14, 1991

[30] Foreign Application Priority Data

Aug. 14, 1990 [FR] France ..... 90 10605

[51] Int. Cl.[5] ..... B65D 41/02

[52] U.S. Cl. ..... 215/253; 215/250; 215/235; 215/318; 215/32

[58] Field of Search ..... 215/237, 235, 250, 318, 215/253, 32

[56] References Cited

U.S. PATENT DOCUMENTS

| | | | |
|---|---|---|---|
| 4,402,415 | 9/1983 | Hopley | 215/32 |
| 4,666,063 | 5/1987 | Holoubek et al. | 215/250 X |
| 4,884,705 | 12/1989 | Debetencourt | 215/250 |
| 4,940,167 | 7/1990 | Fillmore et al. | 215/237 X |
| 4,998,988 | 3/1991 | Zinnbauer | 215/250 X |
| 5,007,546 | 4/1991 | Rose et al. | 215/253 X |

FOREIGN PATENT DOCUMENTS

| | | |
|---|---|---|
| 0137458 | 4/1985 | European Pat. Off. . |
| 0214095 | 8/1985 | European Pat. Off. . |
| 0192011 | 8/1986 | European Pat. Off. . |
| 2017661 | 3/1978 | United Kingdom . |

*Primary Examiner*—Allan N. Shoap
*Assistant Examiner*—Paul A. Schwarz
*Attorney, Agent, or Firm*—Pollock, Vande Sande & Priddy

[57] ABSTRACT

The assembly of a closure (3) and a receptacle (1) having a neck (2) of plastic material surmounted by a tamperproof cover 98). The closure (3) comprises an opening capsule (3) provided with a base (4), and the base (4) and the neck (2) are configured for snap-on engagement after the commencement of insertion in full cross-section of a fitting device (25) onto the cover (8), and, lower down, a screwing device, these devices (15 and 25) allowing the cover (8) to be ruptured and to be fitted into the neck (2).

12 Claims, 2 Drawing Sheets

ASSEMBLY COMPRISING AN OPENING CAPSULE AND A RECEPTACLE WITH A TAMPERPROOF COVER

FIELD OF THE INVENTION

The invention relates to an opening or stub capsule comprising a base or stub fixed to the neck of a receptacle and an opening part which closes the orifice of the neck, opening of this part being effected, for instance, by rotation or by pivoting in relation to the base, the orifice in the neck being initially provided with a tamperproof cover.

BACKGROUND OF THE INVENTION

Opening capsules of plastic material having a base or stub fixed on the neck of plastic material of a tube, typically by snap fit, are known in the art, the base comprising a sealing-tight means acting via the interior of the neck, for example a crown inserted by force into the interior of the neck.

Applicant's EP-B-O 192 011 discloses another type of stopper, namely, a cap comprising means for axially force-fitting a tamperproof cover which surmounts the neck of a receptacle. The fitting means are longitudinal scoring radial fins of a plastic material which is harder than that used for the cover.

Applicant have sought to develop an opening capsule adapted to fit such a receptacle which has a tamperproof cover.

SUMMARY OF THE INVENTION

The object of the invention is an assembly comprising a closure means and a receptacle having a neck of plastic material surmounted by a tamperproof cover. the closure means comprises means for axially force-fitting the cover and being of a plastic material harder than that of the neck and of the cover. The closure means is an opening capsule provided with a base or stub. The base and the neck comprise complementary snapping-on means whose action occurs only after the beginning of fitting under maximum force of the fitting means onto the cover, and complementary screwing means below the snap-on means, the snap-on means and screwing means facilitating breakage of the cover and its insertion into the neck.

The axial force-fitting means of the capsule have a clamping function as well as an anti-rotation function, resulting in the cover being retained in the capsule. Preferably, the said means are either longitudinal fins inside the capsule to be inserted between longitudinal raised potions in the cover or, as disclosed in EP-B-O 192 011, they may be longitudinal radial fins for scoring the cover. At any rate, there is a stage where the fitting effort is or becomes maximum, and the objective of obtaining a permanent clamping effect makes it desirable to select a plastic material which is harder than that used for the cover.

An explanation of the general principle of separation of the maximum force for fitting and for snapping-on will now be given for the example of a capsule having radial scoring fins.

The beginning of the pushing of the capsule, i.e., of the closed assembly comprising the "stub or base plus the opening part," onto the neck which is fitted with its cover calls for two quite substantial efforts, separated in time, for a mechanized insertion plant, i.e., (1) the effort of scoring the cover, and (2) the effort required for snapping the base of the cap on the neck. It was determined that the force required for scoring or inserting the radial fins into the cover is at its maximum at the moment when such insertion attains a maximum cross-section, and that the simultaneity of this effort with the snapping on effort could result in the installation being halted. The snapping-on action is retarded relative to the full cross-section scoring by commencing this fitting slightly after engagement of the opening part on the cover and/or by moving the snap-on means of the neck away from its orifice, which is closed by the cover. Nevertheless, it is preferable to have at the apex of the cover a chamber of minimal height which renders the onset of scoring progressive, and also a progressive widening of the bottom of the said radial fins. Satisfactory separation of the two maximum efforts, i.e., scoring of the cover by the opening part and snapping-on of the base and the neck, is essential in practice.

Once snapping-on is completed by pushing the capsule onto the neck, the capsule is locked against the three usual actions, i.e., it cannot be withdrawn by pulling, it cannot be unscrewed and it cannot be opened by pivoting.

Preferably, the means of screwing the neck immediately succeeds the means of screwing the base of the capsule in the position which has just been snapped on, and in this position the base is locked or is extensively braked against possible rotation in the unscrewing direction and eventually the anti-unscrewing means come into play with effect from the snapped-on position, preventing such rotation The just snapped-on position is the position in which the receptacle fitted with a capsule (and in the absence of tampering) is delivered, and this can be identified by a control, e.g., a colored field on the shoulder of the receptacle visible at this stage between the shoulder and the bottom end of the outer skirt of the base of the capsule.

The capsule is rotatable only in the direction of screwing, i.e., the normal direction of closure, and its opening part, as it is rotated, entrains the cover via its scoring and tears the connecting film of the cover rapidly, typically after 1/10 of a turn with or without screwing by shearing action.

As the screwing proceeds, the bottom end of the cover enters the orifice in the neck and occludes it, the receptacle then being opened by pivoting of the opening part of the capsule and of the cover which remains captive therewith.

Preferably, provision is made, at the earliest when snapping on and at the latest at the end of screwing, for the intervention of supplementary means opposing unscrewing of the base of the capsule and of the receptacle. These means may be fins or ratchet-teeth carried respectively by the inside surface of the outer skirt of the capsule and by a lateral surface of the receptacle, typically its shoulder These supplementary means oppose the unscrewing of the base and allow only an angular movement of less than 10°.

Other particular features will be illustrated and described in the following examples

ADVANTAGES OF THE INVENTION (1) Positioning of the opening capsule is achieved by simple pushing on, and it may be carried out without incompatible effort in a mechanized closure plant, thanks to the separation in time of the maximum fitting and snapping-on efforts.

(2) Pushing stops when snapping-on is achieved, i.e., the condition at delivery when it can be confirmed that the receptacle has not been tampered with can be inspected just below the base of the capsule and also possibly in the central orifice of the opening part inside which the cover of the receptacle has not yet completed rising.

(3) Rotation in the screwing direction after snapping is the only possible way of rupturing the cover, screwing it fully produces a final fixing of the capsule by the anti-unlocking means. Successive openings and closings of the capsules no longer produce any alternation in its fixing, and the cover which is captive of the opening part will reproducibly close the orifice of the neck every time.

(4) In service, the cover is the sealing means of both the re-closing and of the capsule; this constitutes a simplification of the device.

BRIEF DESCRIPTION OF THE DRAWINGS

In order that the invention may be more clearly understood, reference will now be made to the accompanying drawings, in which an embodiment of the invention is shown for purposes of illustration, and in which.

DESCRIPTION OF PREFERRED EMBODIMENT

Figure 1:
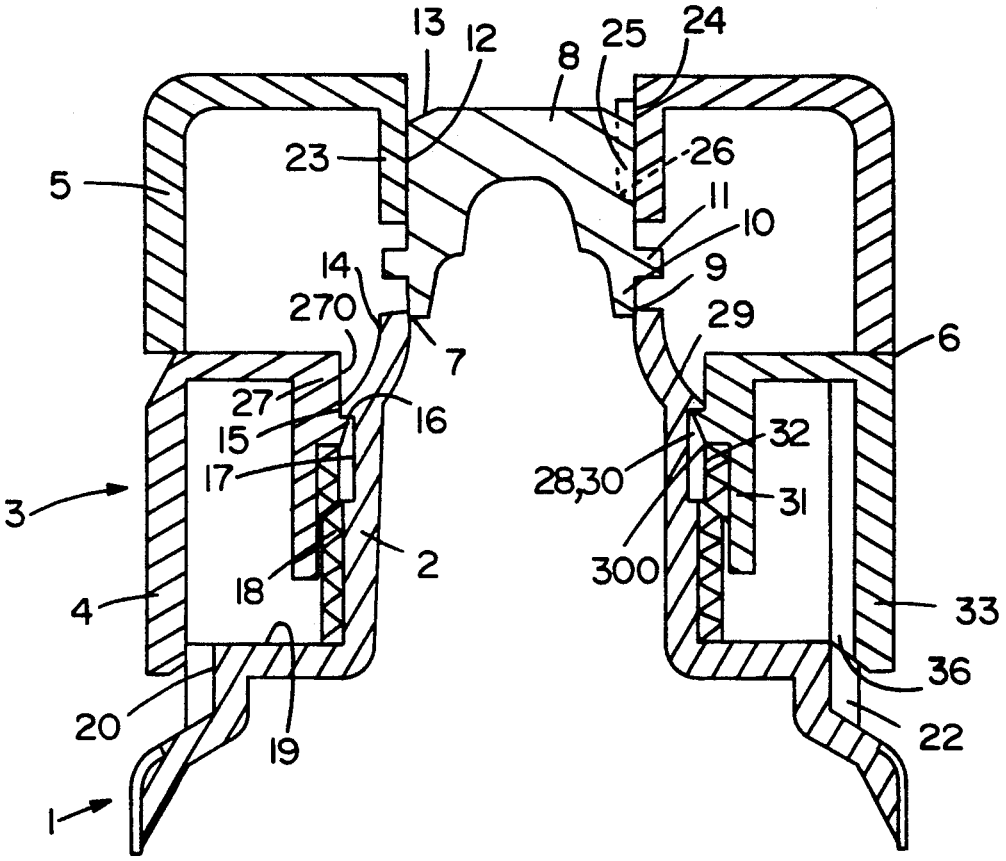
FIG. 1 shows an assembly according to the invention in the snapped-on position, in cross-section.

Shown in FIG. 1 is a tube 1 with a neck 2 of LDPE (low density polyethylene) surmounted by an opening capsule 3 of PP (polypropylene) comprising a stub or base 4 and an opening part 5 adapted to pivot about a hinge at 6 in relation to the base 4.

The neck 2 has an end orifice 7 with a diameter of 7.5 mm, and is surmounted by a sealing-tight cove 8 connected to the interior of the neck by a narrow tear-off portion 9 having a thickness of 0.2 mm. Above this position 9, the cover successively comprises an externally convex annular skirt 10 having an outside diameter which is 0.01 to 0.4, and preferably 0.2 mm greater than the diameter of the orifice 7, and then an annular rim 11 having an outside diameter of 10.5 mm which serves as a sealing-tight abutment for the forthcoming insertion of the stopper 8 into the orifice 7 and as a security abutment for the rising of the cover in the cap 5, and then finally a cylindrical portion 12 with a height of 5 mm and a diameter of 8.8 mm carrying at its top end a slight intake chamfer 13 which is 0.4 mm high.

4 mm below its orifice 7, at the bottom end of an outer inclined surface 14 of increasing diameter, neck 2 has a snap-on projection in the form of a rib 15 having an outside diameter of 13 mm and a horizontal annular underside 16 which surmounts a cylindrical backward portion 17 which is 12 mm in diameter and 3 mm in height. This backward portion 17 is followed by a slightly thicker portion carrying an external screw thread 18 of 1.5 mm pitch and of a total height of 5 mm.

Figure 3:
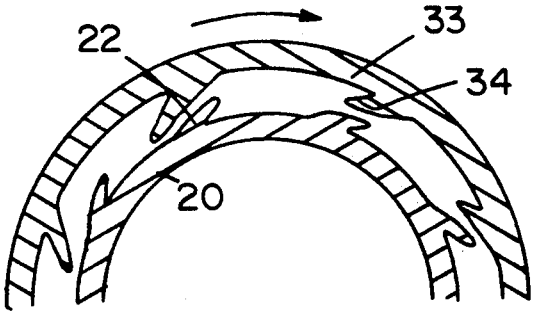
FIG. 3 is a top plan view of the anti-unscrewing means of the assembly in a half-section taken on line A—A in FIG. 2.
Figure 4:
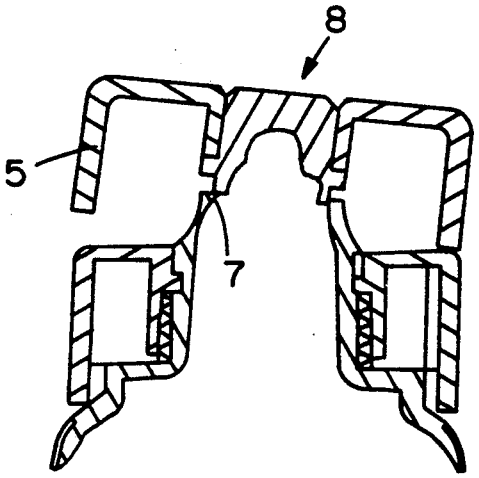
FIG. 4 shows the same assembly after screwing on, likewise in cross-section, the capsule being in the course of being opened.

This screw thread 18 ends on the shoulder 19 of the tube 1, which comprises a lateral surface 20 with a colored field 21 and ratchet teeth 22 which are shown inclined in the screwing direction (FIG. 3), although they may likewise be radial.

The opening part 5 of the capsule 3 comprises a central tubulure 23 open at both ends, its inner surface 24 having a diameter of 8.9 mm and comprising radial fins 25 with an end tapered at an angle of 15° and tapered edges of 0.1 to 0.3 mm thickness, and a bottom end 26 which flares out. progressively. The slight diametral clearance of the surface 24 between fins in relation to the cove 8 will facilitate fitting of the cover into the tubulure 23 in spite of its small scoring beads or incision by fins 25.

The base 4 of the capsule 3 comprises a central cylindrical portion 27 with an inside diameter 270 of 13 mm and a height of 2.5 mm, having at its bottom a snap-on projection 28 with a horizontal ledge 29 having an inside diameter of 12.35 mm, then a frusto-conical engaging surface 30 1 mm high and 13.2 mm in diameter at its base 300. The central portion 27 and the projection 28 extend via tubulure 31 carrying in its top part, just below the projecting portion 28, an internal screw thread 32 of 2.3 mm height which is screwed onto the screw thread 18 of the neck. The outer skirt 33 on the base 4, having an inside diameter of 26 mm, carries on its inside surface inclined fins 34 (FIGS. 1 and 3) to prevent unscrewing, which fins cooperate with the teeth 22 on the neck 2 from the time the capsule 4 and 5 is locked by snapping on.

AXIAL PUSHING OF THE OPENING CAPSULE ONTO THE NECK (FIG. 1)

When capsule 3 or 4 and 5 is pushed axially onto the neck 2 surmounted by the cover 8, the following take place in succession:

- free engagement of the base 4 on the neck 2;
- engagement of the tubulure 23 of the cap opening part 5 around the cover 8, progressive beginning of the scoring of this cover 8 by the ends 26 of the cutting fins 25 with effect from the chamfer 13 of the cover;
- approximately 1 mm lower, insertion of the fins 25 into the cover 8 is of full cross-section; at the same time, the base 300 of the snap-on projection 28 of the base 4 engages without clearance around the matching projection 15 on the neck;
- engagement of the projection 28 around the projection 25 is continued via its frusto-conical surface 30, the snapping-on effort increasing progressively until the end of its horizontal ledge 29 passes underneath the projection 15;
- a stable position is then reached in which disengagement or axial pushing on is no longer possible, on account of the snapping and of the abutment of the screw thread 32 of the base 4 on the commencement of the screw thread 18 on the neck 2, and of the engagement of the anti-unscrewing means 34 and 22.

In this position, the respective bottom ends of the outer skirt 33 and of the tubulure 31 of the base 4 are approximately 2.4 mm from the shoulder 19 of the tube 1. The colored field marks this waiting position in which the tube 1 is still closed in sealing-tight fashion by its cover 8.

OPERATION OF THE TUBE

Figure 2:
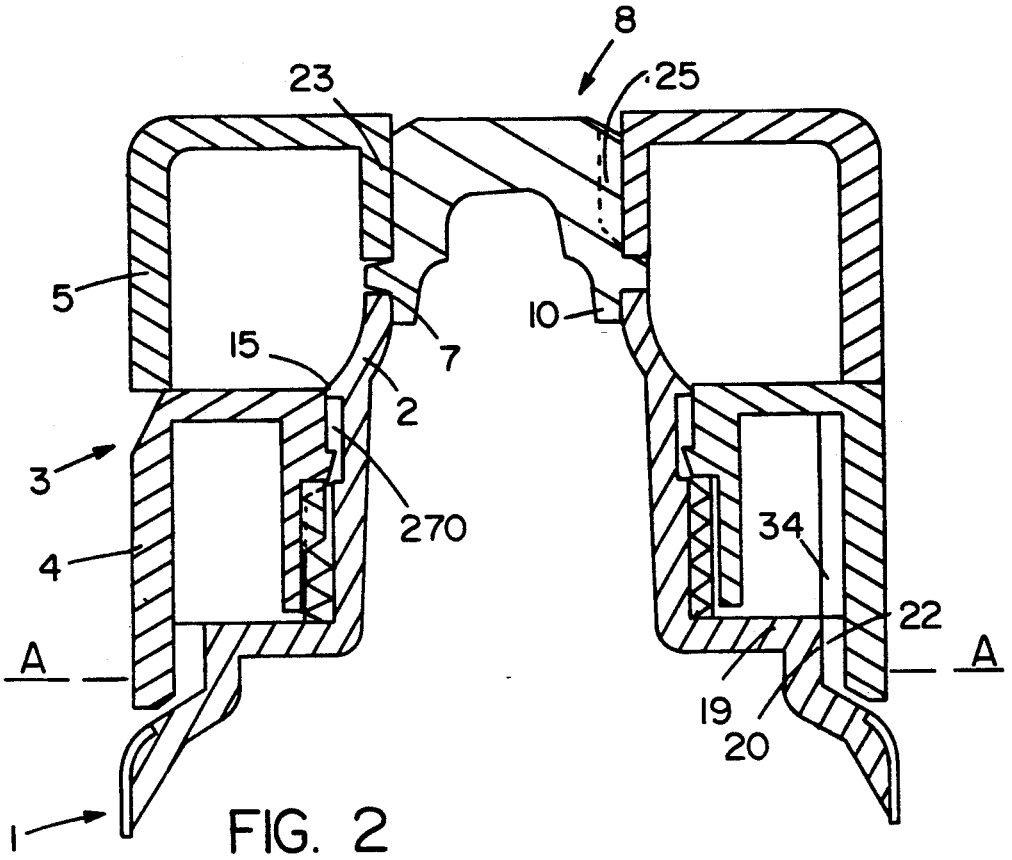
FIG. 2 shows the same assembly in the screwed-on position, also in cross-section.

Rotation of the capsule 3 in the screwing direction but without screwing or indeed with the onset of screwing makes it possible to leave this stand-by position. The cover 8 is caused to rotate by the part 5 and the insertion of its radial fins 25, its tear-off connection 9 (FIG. 1) to the neck 2 being rapidly sheared. After a rotation of about 30°, this connection 9 is broken, the bottom end of the skirt 10 of the cover being pushed into the orifice 7 during screwing (FIG. 2), the connection 9, in order to facilitate this pushing, having an outside diameter which is slightly smaller than the diameter of the orifice 7.

Continuation of the screwing-in process by the user is accompanied by the following effects:

- the anti-unscrewing fins 34 (twelve in number), inclined at 30° in relation to the outer skirt 33, scrape over the anti-unscrewing teeth 22 (five in number) which are carried by the shoulder 19 of the tube 1, any attempt at unscrewing being rapidly locked from the snapping-on stage (FIG. 3);
- the cover 8 has re-entered the orifice 7 of the neck 2 as far as its annular cap 11, ensuring a seal-tight closure (FIG. 2);
- the cover 8 is thus raised up in the tubulure 23 of the opening part 5. This rising of the cover 8 in the screwing phase may serve as evidence that the packaging has not been tampered with.
- the snap-on projection 15 on the neck 2 is located towards the top of the cylindrical opening 270 of the base 4 and ensures seal-tightness between the neck and the base 4.

SUBSEQUENT USAGES (FIG. 4)

The cover is removed from the orifice 7 by pivoting of the opening part 5 and accompanies it as it opens. Closure of opening part 5 is accompanied by seal-tight re-closing of the orifice 7 by the cover 8 which is captive with opening part 5.

INDUSTRIAL APPLICATION

Tamperproof receptacles surmounted by an opening capsule are used for hygiene products, pharmaceuticals, cosmetics, foodstuffs and cleansers.

We claim:

1. An assembly comprising (a) an opening capsule, consisting of an opening part (5) and of a base (4), and a receptacle (1) having a neck (2) of plastic material surmounted by a tamperproof cover (8) which is connected to said neck (2) by a tearable zone (9);

(b) said opening part carrying means (25) for axially force-fitting said cover (8) into said opening part;

(c) said base (4) and said neck (2) having thereon complementary snap-on projections (28 and 15) so situated that, when said capsule (3) is pushed onto said neck (2), one of said complementary projections engages around the other of said complementary projections only after force-fitting of said cover by said axially force-fitting means (25) has attained maximum force;

(d) said base and said neck comprising below said snap-on projections (28 and 15), complementary screw threading (32 and 18), whereby downward screwing of said capsule results in rupture of said cover (8) by shearing said tearable zone (9) and then pushing said cover (8) into said neck (2).

2. An assembly according to claim 1, wherein said capsule (3) is made of a plastic material harder than the plastic material of said neck (2) and said cover (8).

3. An assembly according to claim 1, wherein said snap-on projection (28) of said base (4) comprises a frusto-conical surface (30) engaging around said snap-on projection (15) of said neck (2) and allowing progressive increase in snap-on effort, and wherein said base (4) has an inner tubulure (31) which carries inside it said snapping-on means and said screw threading (32) of said base (4).

4. An assembly according to claim 3, wherein said snap-on projection (15) of said neck (2) is a rib (15) which engages with force into an inner cylindrical portion (27) of said tubulure (31), said cylindrical portion (27) surmounting said snap-on means (28).

5. An assembly according to any one of claims 1–4, wherein said screw threading (18) of said neck (2) is located immediately below said screwing means (32) of said base (4) in snapped-in position.

6. An assembly according to claim 1, wherein said base (4) comprises an outer skirt (33) having an inside which carries anti-unscrewing stop means (34) which, upon snapping-on, cooperate with complementary means (22) carried by a shoulder (19) of said receptacle (1).

7. an assembly according to claim 6, wherein said anti-unscrewing stop means (33 and 34) respectively consists of fins (34) inside said outer skirt (33) and ratchet teeth (22) carried by a lateral surface (20) of said shoulder (19).

8. An assembly according to claim 7, wherein said internal fins (34) and said ratchet teeth (22), in snapped-on position, cooperate and prevent rotation in an unscrewing direction.

9. An assembly according to claim 6, wherein a bottom end of said outer skirt (33) is situated above said shoulder (19) of said receptacle (1) in the snapped-on position prior to screwing, said skirt (33) then exposing a control (20) of non-descent of said capsule (3), said control (20) being carried by said shoulder (19).

10. An assembly according to claim 1, wherein said cover (8) comprises said tearable zone (9) and an externally convex annular skirt (10) above said tearable zone, said skirt having an outside diameter which is greater by 0.1 to 0.4 mm than the diameter of an end orifice (7) of said neck (2) and above said tearable zone an annular skirt (10) an annular rim (11) serving both to arrest pushing of said capsule (3, 4) over said cover (8) and to abut said cover (8) on an end of said neck (2) in an event of renewed closure operations.

11. An assembly according to claim 25, wherein said opening part (5) has an open axial passage (24), and wherein said force-fitting means (25) are constituted by scoring fins (25) carried by said open axial passage (24) and having tapered edges of 0.1 to 0.3 mm thickness which are adapted to score a circular cylindrical portion (12) of said cover (8).

12. An assembly according to claim 1, wherein said cover (8) is a means for re-closing said receptacle (1) in a seal-tight manner upon every closure of said capsule (3).

* * * * *

UNITED STATES PATENT AND TRADEMARK OFFICE

CERTIFICATE OF CORRECTION

PATENT NO. : 5,203,838

DATED : April 20, 1993

INVENTOR(S) : Bernard Schneider

It is certified that error appears in the above-identified patent and that said Letters Patent is hereby corrected as shown below:

Col. 6, claim 11, line 55, change "25" to --1--

Signed and Sealed this

Twelfth Day of April, 1994

Bruce Lehman

*Attest:*

BRUCE LEHMAN

*Commissioner of Patents and Trademarks*

*Attesting Officer*